United States Patent [19]

Rolls

[11] 4,052,313

[45] Oct. 4, 1977

[54] MATERIAL RECOVERY SYSTEMS

[75] Inventor: George Henry Rolls, Lymington, England

[73] Assignee: John Rolls, Dorset, England; a part interest

[21] Appl. No.: 674,756

[22] Filed: Apr. 8, 1976

[30] Foreign Application Priority Data

Apr. 14, 1975 United Kingdom ..... 15249/75

[51] Int. Cl.[2] ..... E02B 15/04

[52] U.S. Cl. ..... 210/242 AS; 210/DIG. 26

[58] Field of Search ..... 210/83, 242, DIG. 25, 210/DIG. 26, 39, 40

[56] References Cited

U.S. PATENT DOCUMENTS

| | | | |
|---|---|---|---|
| 3,612,280 | 10/1971 | Fitzgerald | 210/DIG. 25 |
| 3,679,058 | 7/1972 | Smith | 210/DIG. 26 |
| 3,695,451 | 10/1972 | Schmidt, Jr. et al. | 210/DIG. 25 |
| 3,700,593 | 10/1972 | Bezemer et al. | 210/DIG. 26 |
| 3,730,346 | 5/1973 | Prewitt | 210/DIG. 25 |
| 3,744,638 | 7/1973 | Rhodes | 210/DIG. 26 |
| 3,847,816 | 11/1974 | Di Perna | 210/DIG. 25 |
| 3,990,975 | 11/1976 | McLellan | 210/DIG. 26 |

*Primary Examiner*—Theodore A. Granger

*Attorney, Agent, or Firm*—Kenyon & Kenyon, Reilly, Carr & Chapin

[57] ABSTRACT

The present disclosure is directed to a material recovery system which utilizes a rope of an adsorbent material arranged for floating on the surface of a liquid contaminated by a contaminating material preferentially adsorbed by the rope. The rope is in the form of a continuous loop extending between a desorption station through which the rope is advanced to remove adsorbed material and a rope-guide station or each of a plurality of rope-guide stations at which the rope is guided round guide means. Hold-off means controlled by or from the desorption station are provided for holding off the rope-guide station or each of the rope-guide stations from the desorption station by a predetermined distance without the use of an anchor.

6 Claims, 2 Drawing Figures

MATERIAL RECOVERY SYSTEMS

Figure 1:
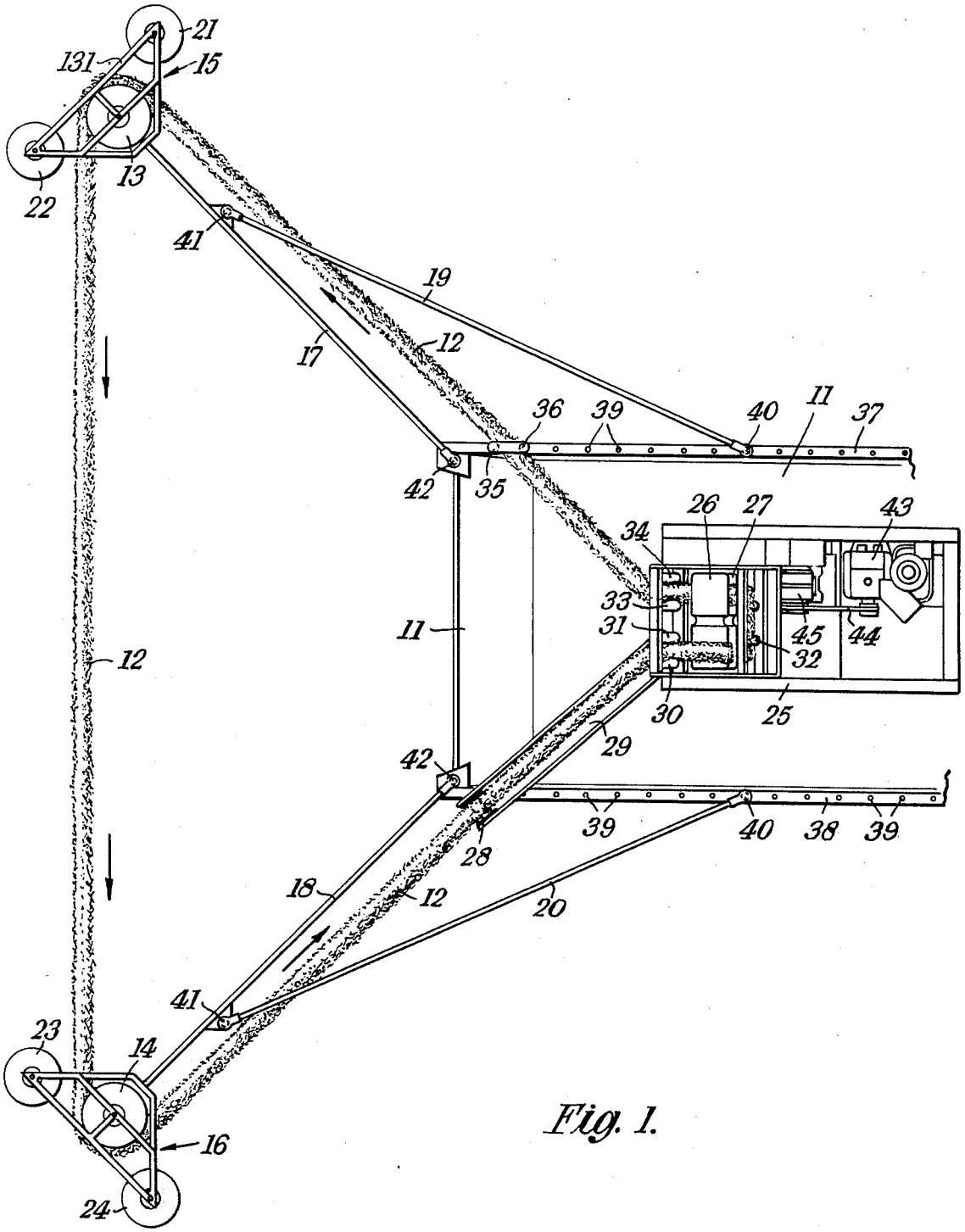

The present invention relates to material recovery systems and is particularly although not exclusively concerned with a recovery system for the removal of oil from the surface of water.

In an oil recovery system hitherto proposed, use is made of a buoyant rope which has the property of preferentially adsorbing oil in relation to water and which is formed as a continuous loop which floats on the water between a desorption station where it is advanced through an oil desorption means and one or more rope-guide stations remote from the desorption station where the run of the loop is guided round one or more guide pulleys floating on the water. The rope is continuously advanced in its run over the water, around the pulley or pulleys and through the desorption unit, the oil being removed from the incoming run of the rope to produce a continuously cleaned return run for a further advance over the oil contaminated water.

The oil desorption station may simply comprise a pair of squeeze rollers through the nip of which the rope is caused to pass, the rollers serving to wring out oil in the oil-laden run advanced to it whilst providing the drive for the advancement of the rope. For heavy duty operation additional squeeze rollers may be provided or the oil laden rope may be caused to make more than one pass through the single pair of squeeze rollers.

The desorption station in the oil recovery systems hitherto proposed may be a land station at the edge of the water or a vessel in the form of, say, a barge anchored offshore or moving slowly through the oil-contaminated water, while the rope-guide stations may simply comprise a floating pulley anchored to an opposite shore or to the water bed or tied to a small manned boat which is either anchored offshore or is advanced slowly through the water, the positions of the desorption station and rope-guide station or stations being so chosen as to bring the rope loop into or hold it in a position in which it is most effective for picking up and containing the oil floating on the water.

It will be appreciated that the repositioning of the site of the simply anchored pulley is at best a tedious operation and the need from time to time for complete withdrawal of the rope loop leads to further inconvenient operations. Where the oil recovery system is employed at a permanent site it has been proposed to employ a chain loop traversing the water bed and passing through an anchor at the guide-station, the floating pulley being attached to the chain so that it can be withdrawn to the desorption station. Chain withdrawal of the pulley is however of very limited application.

While the use of a small manned boat as the rope-guide station gives much more flexibility to the recovery system, additional personnel are required to man the boat, leading to prohibitive operating costs.

According to the present invention, there is provided a material recovery system comprising a rope of an adsorbent material arranged for floating on the surface of a liquid contaminated by a contaminating material preferentially adsorbed by the rope, the rope being in the form of a continuous loop extending between a desorption station through which the rope is advanced to remove adsorbed material and a rope-guide station or each of a plurality of rope-guide stations at which the rope is guided round guide means, and hold-off means controlled by or from the desorption station for holding off the rope-guide station or each of the rope-guide stations from the desorption station by a predetermined distance without the use of an anchor.

In one embodiment of the invention, the rope-guide station or each of the rope-guide stations comprises a floating rope guide unit including said guide means and the said hold-off means comprises a strut or an assembly of struts secured at one end to the desorption station and supporting at its other end the floating rope guide unit, the arrangement being such that the rope guide unit has sufficient freedom of movement to allow it to remain in a floating disposition for a predetermined range of dispositions of the desorption station.

In another embodiment of the invention, the or each rope guide station is an unmanned power driven unit having remotely controlled steering means and the hold-off means comprises a remote control system operated from the barge and transmitting position or guidance control signals to the steering means of the or each rope guide unit either by radio transmission or by transmission cables connected between the rope guide unit and the barge.

Figure 2:
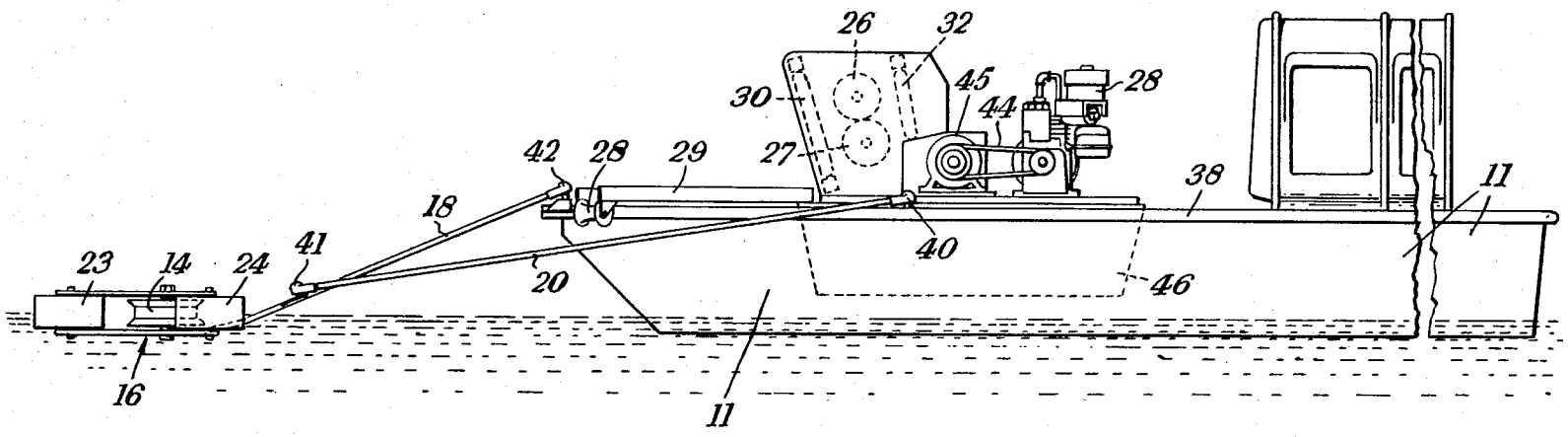

An embodiment of the invention will now be described by way of example with reference to the accompanying drawings in which:

FIG. 1 is a schematic plan view of part of an oil recovery system according to the invention and FIG. 2 is a schematic side elevation of the oil recovery system shown in FIG. 2.

Referring to the drawings and principally to FIG. 1, the oil recovery system shown comprises a barge 11, an oil-adsorbing rope 12 in the form of a continuous loop and arranged to float on water ahead of the barge 11 by passage round pulleys 13 and 14 carried by float units 15 and 16 held in spaced relation ahead of the bows of the barge by struts 17, 18, 19 and 20.

The float unit 15 is, as shown, rigidly but detachably connected to one end of the strut 17, the other end of which is pivotally mounted on the side of the barge in the region of the bows. The struct 19, which holds the strut 17 against angular displacement in a horizontal plane is pivotally mounted at one end to the side of the barge at an intermediate position therealong and at the other end to an intermediate point on the strut 17. The float unit 16 is, likewise, rigidly but detachably fixed to the end of the strut 18, which is pivotally mounted on the other side of the barge, the strut 20 holding the strut 18 against horizontal angular displacement and being pivoted in the same manner as the strut 19.

The float unit 15 is made up of the pulley 13 which is self supporting in the water and two stabilising floats 21 and 22, the pulley 13 and the floats 21 and 22 being supported by and freely rotatable in a frame 131. The float unit 16 is made up in the same manner with stabilising floats 23 and 24.

In the region of the bows of the barge there is provided a drive and desorption unit 25 through which the rope 12 is advanced. The unit 25 comprises a pair of drive rollers 26 and 27 arranged to be driven by a petrol or diesel engine 43 via a chain drive 44 and a clutch mechanism 45. The chain drive 44 may, if desired, be replaced by a hydraulic drive and in some situations the clutch mechanism is omitted. The rollers 26 and 27 form two nips through which the rope 12 passes in turn, as shown, the rollers serving to draw the oil-laden run of the rope 12 from the water over a guide roll 28, along an oil drip trough 29, between vertically arranged guide rolls 30 and 31, over the drive roller 26, through the first nip between the rollers 26 and 27, under the roller 27, around spaced vertically arranged guide rolls, one of which is shown at 32 in FIG. 2, through the second nip between the rollers 26 and 27, between a further pair of vertically arranged guide rolls 33 and 34 and then in its forward run into the water between spaced vertically arranged guide bars 35 and 36 mounted on the side of the barge 11 in the region of the bows. The rollers 26 and 27 whilst drawing the oil-laden run of the rope 12 in the manner described simultaneously squeeze out adsorbed oil which is then collected in a tank 46 provided beneath the desorption unit 25. An oil pump (now shown) driven by the engine 43 is mounted in the tank 46 and employed to pump collected oil from the tank by hose lines to flexible containers arranged for floating alongside the barge. The run of the rope 12 passing into the water is guided round the pulley 13 into a path across the bows of the barge 11, round the pulley 14 and back to the unit 25, adsorbing oil during its passage in the water. The barge 11 may be anchored in the path of an oil spill or can be advanced through the contaminated area, the float units 15 and 16 being held at fixed distances from the bows of the barge 11.

It will be seen that the barge is provided at its sides with horizontally arranged support rails 37 and 38, each rail being provided with spaced holes 39 along the length thereof. In the arrangement shown in the drawings, each of the struts 19 and 20 is pivotally connected to the side of the barge by a ball and cup universal joint mounting 40, the cup portion of which is secured to the strut and the ball portion of which provided with a spigot which slidingly engages in one of the holes 39 in the rail 37. Repositioning of the mounting 40 to engage others of the holes 39 in the rail 37 permits variations in the positions of the float units 15 and 16, either to increase or reduce the catchment area of the rope 12. The other ends of the struts 19 and 20 are pivotally connected to the struts 17 and 18 by detachable ball and cup universal joint mountings 41 which provide for ready detachment when the equipment is to be stowed away in the barge.

The struts 17 and 18 are pivotally connected to the bows of the barge 11 using detachable ball and cup universal joint mountings 42 identical to the mountings 40 employed for the struts 19 and 20 likewise to provide for ready detachment and so that the struts 17 and 18 can if desired be pivotally connected along the sides of the barge 11 by utilising the holes 39 in the rails 37 and 38.

For some purposes it may be found useful to operate the rope 12 in a trailing position either by reversing the direction of motion of barge 11 or mounting the float units 15 and 16 and the unit 25 at the stern of the barge.

The arrangement of the float unit 15 and the struts 17 and 19 may if desired be repeated on each side of the barge 11 at the stern and the rope loop 12 arranged to pass round the pulleys of all four units and in addition to pass through the drive and desorption unit 25.

The rope 12 may comprise a rope core to which is woven a thick nap of adsorbent material which preferentially adsorbs oil, the whole of the rope having a specific gravity less than 1.

In another embodiment of the invention, a barge which is of the same form as the barge 11 is provided with a rope drive and desorption unit 25 as illustrated. The rope 12 is, however, guided by one or more remotely controlled unmanned power driven float units, the unit or each unit being held in spaced relation to the barge by a remote control system operated from the barge and transmitting position or guidance control signals to steering apparatus on the unit either by radio transmission or by transmission cables connected between the float unit and the barge. The size and power of the float units will of course depend upon the conditions under which the system is required to operate and the loading placed upon the float unit by the size and/or length of the rope.

It will be appreciated that a rope loop may be provided on each side of the barge, one being held by a first remotely controlled power driven float guided on one side of the barge and the other being held by a second remotely controlled power driven float on the other side of the barge.

The recovered oil extracted by the desorption unit on the barge may conveniently be pumped into flexible containers, which can then be floated and towed by the barge.

What I claim as my invention and desire to secure by Letters Patent is:

1. In an oil recovery system, the combination of a marine craft arranged for movement on the surface of water contaminated by oil, oil extraction means mounted on said craft, a continuous loop of a rope of adsorbent material which is arranged for floating on the surface of the water in proximity to the craft, said rope preferentially adsorbing oil from the water and passing to said extraction means for extraction of oil therefrom, a rope guide float unit arranged for floating on the water and including rope guide means around which the rope is guided, and a float unit support structure comprising rigid strut means connected at one end direct to the float unit, pivotal mounting means pivotally mounting the other end of the strut means on the craft at a pivot position thereon to permit pitching movement of the float unit relative to the craft while maintaining the float unit at a predetermined distance from said pivot position, and restraining means preventing yaw movements of the float unit relative to the craft.

2. In an oil recovery system, the combination of a marine craft arranged for movement on the surface of water contaminated by oil, oil extraction means mounted on said craft, a continuous loop of a rope of adsorbent material which is arranged for floating on the surface of the water in proximity to the craft, said rope preferentially adsorbing oil from the water and passing to said oil extraction means for extraction of oil therefrom, at least one rope guide float unit for floating on the water and including rope guide means around which the rope is guided, and a float unit support structure comprising first rigid strut means connected at one end direct to the float unit, first pivotal mounting means pivotally mounting the other end of the strut means on the marine craft at a first pivot position thereon to permit pitching movements of the float unit in relation to the craft while maintaining the float unit at a predetermined distance from said first pivot position, second rigid strut means, second pivotal mounting means pivotally mounting one end of the second strut means on the craft at a pivot position thereon horizontally spaced from the first pivot position and third pivotal mounting means pivotally mounting the other end of the second strut means on said first strut means at an intermediate pivot position therealong to prevent yaw movements of the float unit in relation to the craft.

3. The combination claimed in claim 2, wherein each of the pivotal mounting means comprise ball and cup universal joint mountings including a cup element and a ball element, wherein the cup element of each of the ball and cup universal joint mountings of said first and second pivotal mountings means is rigidly connected to the associated strut means and engages downwardly on said ball element and the ball element is formed with a depending spigot, and wherein the craft comprise a horizontally arranged support rail extending along each side thereof, said rail being provided with spaced holes therealong to receive in spaced relation the spigot of said first and second pivotal mounting means.

4. The combination claimed in claim 2, wherein each of the pivotal mounting means comprise ball and cup universal joint mountings including a cup element and a ball element and wherein the cup element of each of the pivotal mounting means engages downwardly on said ball element and is detachable therefrom by upward movement of the cup element.

5. A material recovery system comprising:

a rope in the form of a continuous loop of adsorbent material arranged for floating on the surface of a liquid contaminated by a contaminating material, said rope being preferentially adsorptive of the contaminating material, a floating deadsorption station, at least one floating, spaced rope guide station including guide means for guiding said rope thereabout, strut means for adjustably maintaining each said rope guide station a fixed, adjustable predetermined, yaw position with respect to said deadsorption station, and means for moving said rope through said deadsorption station and about said guide means of each said rope guide station;

said strut means comprising for each said rope guide station first rigid strut means connected at one end thereof pivotably to said deadsorption station and at the other end thereof to a guide station, second rigid strut means pivotably connected at one end thereof to said first strut means and at the other end thereof pivotably connected to said deadsorption station, and means for adjusting the position of said other end of said second strut means on said deadsorption station.

6. The system of claim 5, wherein said first rigid strut means and said second rigid strut means are connected to said deadsorption station by universal joint means.

* * * * *

UNITED STATES PATENT AND TRADEMARK OFFICE

CERTIFICATE OF CORRECTION

PATENT NO. : 4,052,313

DATED : October 4, 1977

INVENTOR(S) : George Henry Rolls

It is certified that error appears in the above-identified patent and that said Letters Patent are hereby corrected as shown below:

Column 2, line 40, "struct" should be --strut--.

Column 6, line 5, "station a fixed" should be --station in a fixed--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*